US006520499B1

(12) United States Patent
Lautenklos et al.

(10) Patent No.: US 6,520,499 B1
(45) Date of Patent: Feb. 18, 2003

(54) DEVICE FOR REMOVING PROOF SHEETS AND REJECT SHEETS FROM A SHEET-PROCESSING MACHINE

(75) Inventors: Udo Lautenklos, Wald-Michelbach (DE); Richard Mack, Kennesaw (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 158 days.

(21) Appl. No.: 09/707,028

(22) Filed: Nov. 6, 2000

(30) Foreign Application Priority Data

Nov. 5, 1999 (DE) ..... 199 53 224

(51) Int. Cl.[7] ..... B65H 29/00
(52) U.S. Cl. ..... 271/280; 271/207; 271/213
(58) Field of Search ..... 271/280, 300, 271/302, 207, 213, 214; 101/37, 40.1, 44, 224, 227, 231, 232, 238, 240

(56) References Cited

U.S. PATENT DOCUMENTS 5,259,608 A * 11/1993 Pollich ..... 271/183
5,746,427 A * 5/1998 Hamid ..... 271/176
5,749,571 A * 5/1998 Heiler ..... 271/213
6,182,567 B1 * 2/2001 Gunschera et al. ..... 101/232
6,311,616 B1 * 11/2001 Kamoda ..... 101/232 X

FOREIGN PATENT DOCUMENTS

| | | |
|---|---|---|
| DE | 40 17 931 A1 | 1/1991 |
| DE | 41 22 329 C2 | 1/1993 |
| DE | 41 38 280 C2 | 5/1993 |
| DE | 44 35 988 A1 | 4/1996 |
| DE | 196 42 118 A1 | 4/1998 |
| DE | 197 30 758 C2 | 1/1999 |

* cited by examiner

*Primary Examiner*—David H. Bollinger
(74) *Attorney, Agent, or Firm*—Laurence A. Greenberg; Werner H. Stemer; Gregory L. Mayback

(57) ABSTRACT

A device for removing proof sheets and reject sheets from a side of a delivery of a sheet-processing machine includes a collecting container for accommodating removed sheets therein in an operating position of the container, the container being displaceable into a park position wherein it is located above the delivery; and a sheet-processing machine, in particular, including the sheet-removing device.

17 Claims, 6 Drawing Sheets

DEVICE FOR REMOVING PROOF SHEETS AND REJECT SHEETS FROM A SHEET-PROCESSING MACHINE

BACKGROUND OF THE INVENTION

FIELD OF THE INVENTION

The invention relates to a device for removing proof sheets and reject sheets from a sheet-processing machine, such as a printing machine.

In sheet-processing machines, especially printing machines, the sheets which may be provided for further processing are deposited at a stacking or pile station to form a stack or pile.

When starting up such a machine, whether when setting up a new printed image, or when starting up in the context of a new operating shift, sheets are printed which do not yet have desired quality and to this extent are faulty and are referred to as reject sheets or waste. These must not be deposited in the pile provided for further processing, but must be removed.

In addition, during the operation of the machine, proof sheets have to be taken regularly, first for continuously checking the quality of the printed image and second for documenting the quality of the print within the context of the standards relating to the operating sequence, such as the ISO 9000 Standard.

For this purpose, it has been known heretofore to delay the release of the sheets conveyed by a chain conveyor and held by grippers, beyond the normal depositing position of the sheets in a stack or pile provided for further processing by later opening of the grippers.

SUMMARY OF THE INVENTION

It is accordingly an object of the invention to provide a device for removing proof sheets and reject sheets from a sheet-processing machine, which affords user-friendly depositing of removed sheets.

With the foregoing and other objects in view, there is provided, in accordance with one aspect of the invention, a device for removing proof sheets and reject sheets from a side of a delivery of a sheet-processing machine, comprising a collecting container for accommodating removed sheets therein in an operating position of the container, the container being displaceable into a park position wherein it is located above the delivery.

In accordance with another feature of the invention, the collecting container, when in the park position thereof, is at least approximately flush with the side of the delivery.

In accordance with a further feature of the invention, the sheet-removing device includes at least one sliding block carrying the collecting container, and two mutually perpendicularly aligned guides for the sliding block.

In accordance with an added feature of the invention, the sheet-removing device includes dovetail tongues and grooves for guiding the sliding block in the mutually perpendicularly aligned guides.

In accordance with an additional feature of the invention, each of the guides has a stationary guide rail and a slide displaceable over a limited path on the guide rail.

In accordance with yet another feature of the invention, the slides, respectively, on a side thereof facing away from the respective guide rail are formed with respective dovetail tongues respectively engaging in a dovetail groove formed in the sliding block.

In accordance with yet a further feature of the invention, the sheet-removing device includes bearings by which the slides are guidable in the respective guide rails thereof.

In accordance with yet an added feature of the invention, the bearings are formed as linear ball bearings, respectively, having a ball cage and balls engaging in partial cylindrical grooves, respectively, formed in the guide rails and the slides.

In accordance with yet an additional feature of the invention, the sheet-removing device includes a respective motor for displacing the slides along the guide rails, respectively.

In accordance with still another feature of the invention, the sheet-removing device includes a threaded spindle for displacing the slides, respectively.

In accordance with still a further feature of the invention, the sheet-removing device includes limit switches arranged in a transfer region for transferring the sliding block from one of the guides to the other, and motors switchable by the limit switches for adjusting the slides.

In accordance with still an added feature of the invention, when the collecting container is in an operating position thereof for accepting the sheets, a guide is assigned to the collecting container for deflecting the sheets into the collecting container after they have been removed from the delivery.

In accordance with still an additional feature of the invention, the sheet-removing device includes suction belts for conveying the sheets, the suction belts being arranged upline of the collecting chamber, when the collecting chamber is in an operating position thereof for accepting the sheets.

In accordance with another feature of the invention, the sheets are removable from a front or end side of the delivery.

In accordance with a further feature of the invention, the two guides are a vertical guide and a horizontal guide.

In accordance with an added feature of the invention, the guides are a vertical guide and a horizontal guide, respectively, and the slides are a vertical slide and a horizontal slide, respectively.

In accordance with a concomitant aspect of the invention, there is provided a sheet-processing machine, in particular, a printing machine, including a device for removing proof sheets and reject sheets from a side of a delivery of a sheet-processing machine, comprising a collecting container for accommodating removed sheets therein in an operating position of the container, the container being displaceable into a park position wherein it is located above the delivery.

With the invention of the instant application, the depositing of removed sheets is user-friendly in that, during continuous pile formation, the collecting container can be left in the park position thereof, and does not hamper access to the delivery. In a preferred development, the collecting container, when in the park position thereof, is at least quite flush with the front or end side of the delivery.

An advantageous configuration provides a slotted-guide or sliding block which is connected to the collecting container, and two guides for the slotted-guide or sliding block, which are arranged perpendicularly to one another.

In a preferred configuration, provision is made for the slotted-guide or sliding block to be guided in the guides by dovetail tongues and grooves. This configuration insures a reliable holding and therefore the possibility of displacing the collecting container carried by the slotted-guide or sliding block or blocks along the guides.

A further preferred configuration provides for each guide to have a stationary guide rail and a slide displaceable over a limited path on the guide rail, the slides, on the side thereof facing away from the guide rail, being formed in particular with dovetail tongues, and therewith, respectively, engaging in a dovetail groove in the slotted guide block.

In a further configuration, provision is made for the slides to be guided in the respective guide rail thereof by bearings, the bearings additionally being formed as linear ball bearings with a ball cage and balls, which engage in partial cylindrical grooves formed in the guide rail and the slide. In this regard, an improvement provides for the slides, respectively, to be capable of being displaceable along the guide rails by a motor, it being possible in particular for the slides to be displaceable by a threaded spindle.

A further configuration is distinguished by the fact that, in a transfer region for transferring the slotted-guide or sliding block from one guide to the other guide, limit switches are arranged which, respectively, in order to switch one of the motors, are linked to the latter. Thereby, a fully automatic sequence or course of the displacement of the collecting container can be effected, in that the slide which is initially disengaged from the slotted-guide or sliding block located in the transfer position thereof, is automatically moved into engagement with the slotted guide block after the actuation of an associated first limit switch and, when that slide reaches its own limit position insuring engagement, by actuating a second limit switch, effects the return of the other slide in order to release the slotted-guide or sliding block from this other slide.

In a further configuration, the invention provides that, when the collecting container is in the operating position thereof for accepting the sheets, it has assigned thereto a guide which introduces the removed sheets into the collecting container. The effect thereof is that a proof or reject sheet led over the sheet pile is transferred reliably into the collecting container. In order to assist in the transfer operation, provision is further made for suction belts to be arranged upline of the collecting container located in the operating position, in order to accept sheets to be removed from chain conveyors of the sheet-processing machine, which convey the sheets.

Furthermore, a subject of the invention is a sheet-processing machine, such as a printing machine, in particular, having a device for removing proof sheets and reject sheets, and a collecting container which accommodates removed sheets in an operating position and is displaceable into a park position, wherein it is located above the delivery, the sheet-removing device preferably having at least one of the features mentioned hereinbefore.

Other features which are considered as characteristic for the invention are set forth in the appended claims.

Although the invention is illustrated and described herein as embodied in a device for removing proof sheets and reject sheets from a sheet-processing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
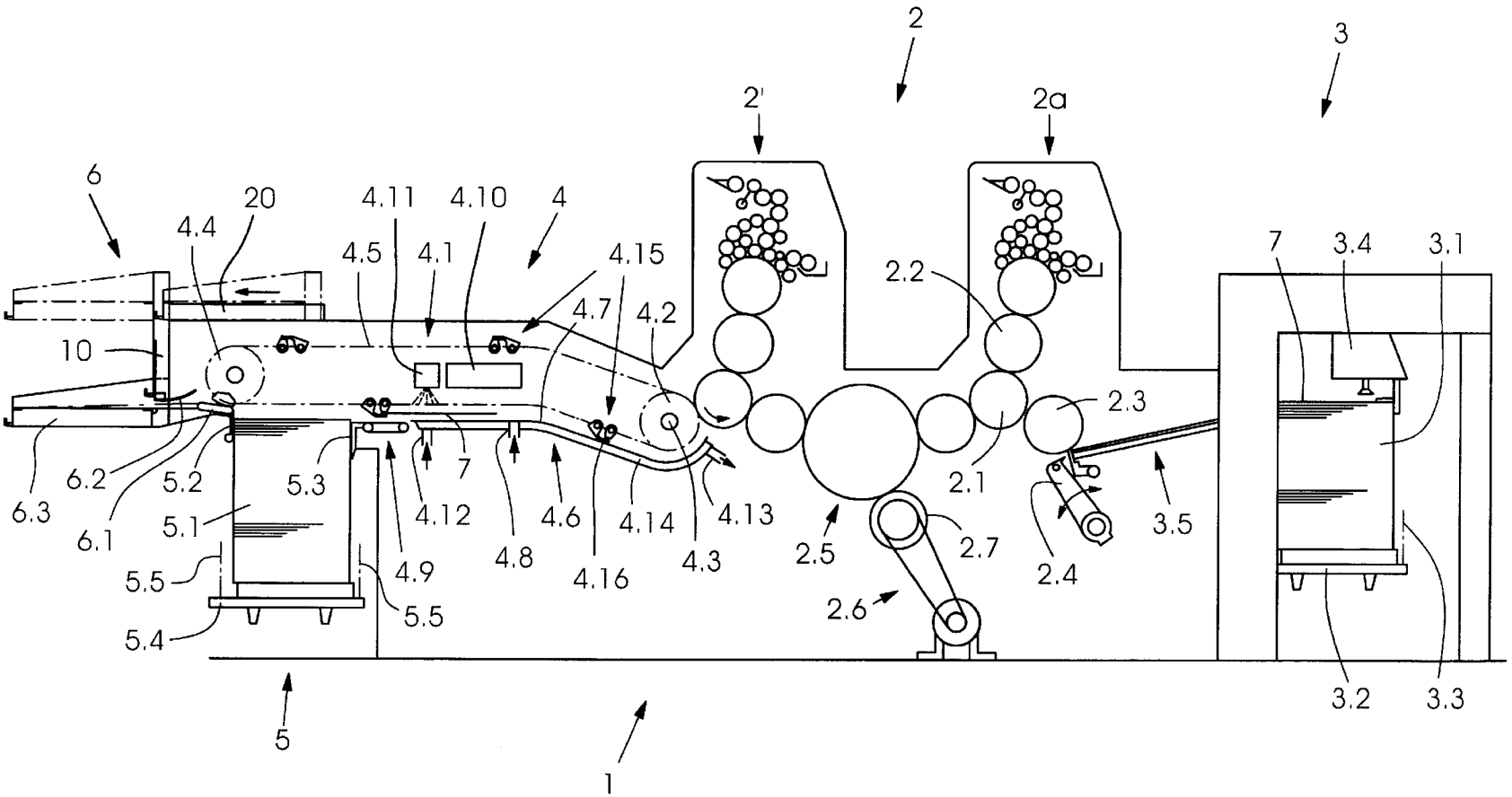
FIG. 1 is a diagrammatic side elevational view overall of a sheet-processing machine in the form of an offset printing machine having a device for removing proof sheets and reject sheets in accordance with the invention.

Referring now to the drawings and, first, particularly to FIG. 1 thereof, there is shown an overall side elevational view of a sheet-processing machine 1. The machine 1 has a printing-unit section 2, a paper feeding device 3 in the form of a sheet feeder, a delivery 4 having a chain conveyor 4.1, underneath an end region of the latter a stacking or pile station 5 and, following the latter, a device 6 for removing proof and reject sheets.

The paper feeding device 3 has a liftable and lowerable platform 3.2 carrying a sheet pile 3.1 resting on a pallet. In order to raise the platform 3.2 stepwise in accordance with pulling sheets from the pile 3.1, a lifting mechanism is provided having lifting chains 3.3 from which the platform 3.2 is suspended.

Provided above the pile 3.1 is a sheet-separating or singling device 3.4 having lifting and pull suckers for gripping the uppermost sheet, respectively, of the pile 3.1 and transferring the sheet to a transporting and aligning device 3.5 including a suction-belt conveyor, the sheets being aligned at the leading edges and one of the side edges, respectively, thereof by the device 3.5 for further transfer.

In the illustrated exemplary embodiment, the printing-unit section 2 has two printing units 2*a* and 2', so that the printing machine 1 shown in FIG. 1 is constructed for printing two colors. In order to print additional colors, a further printing unit has to be provided for each additional color, respectively.

The printing unit 2*a* has an impression cylinder 2.1 and a blanket cylinder 2.2 cooperating therewith, and a feed drum 2.3 for transferring sheets to be printed in the respective printing unit to the respective impression cylinder 2.1. The printing unit 2', of course, has a construction substantially similar to that of the printing unit 2*a*.

Arranged between the transporting and aligning device 3.5 and the feed drum 2.3 is a pre-gripper 2.4, which accepts a sheet aligned at the aforementioned edges and transfers it to the feed drum 2.3, which then transfers it to the impression cylinder 2.1 of the first printing unit 2*a*.

Provided between the printing units 2*a* and 2' is a sheet transfer device 2.5. If two printing units connected by such a sheet transfer device 2.5 print on the same side of a sheet, for example, with different colors, the sheets are transferred by the sheet transfer device 2.5 without being reversed, i.e., unturned; if two printing units, respectively, connected by such a sheet transfer device 2.5, print on a different side, i.e., opposite sides, of a sheet, then the respective sheet transfer device 2.5 is constructed to transfer the sheet to the following printing unit after the sheet has been reversed or turned.

To operate, a drive 2.6 having a belt drive 5 driven by a motor and an output gearwheel 2.7 are provided, the latter meshing with a gearwheel of the sheet transfer device 2.5 in the illustrated embodiment of FIG. 1.

The printed sheets are transferred to the chain conveyor 4.1 of the delivery 4, which likewise is operationally connected to the drive 2.6. For this purpose, drive sprockets 4.2, the cylinders of the respective printing units 2*a* and 2', the feed drum 2.3 and the drum and cylinder arrangement forming the sheet transfer device 2.5 are connected to gearwheels so that they rotate therewith in a manner that they form a train of gearwheels with a respective side strand in a respective printing unit. In the diagrammatic illustration of FIG. 1, these gearwheels are represented in the same manner as a drum connected to one of the gearwheels, respectively, as a cylinder connected to one of the gearwheels, respectively, and as drive sprockets 4.2 which are connected to one of the gearwheels, the drive sprockets, for their part, being fixed to a common sprocket shaft 4.3.

The chain conveyor 4.1 includes two conveyor chains 4.5, of which each, respectively, revolves along a respective side wall of the delivery 4. A respective conveyor chain 4.5 wraps around each of two synchronously driven drive sprockets 4.2, the respective axes of rotation of which are aligned with one another and, in the embodiment of FIG. 1, are guided by a respective guide or deflection sprocket 4.4 located downline of the drive sprockets 4.2, as viewed in the processing direction. Between the two conveyor chains 4.5 there extend gripper systems 4.15 which are borne by the chains 4.5 and have grippers 4.16, which pass through gaps between grippers arranged on the impression cylinder 2.1 and, in so doing, accept a sheet 7 by gripping a gripper margin at the leading end of the sheet 7 directly before the grippers arranged on the impression cylinder open. In the embodiment at hand, the sheets 7 are transported by the lower chain strand in FIG. 1. The section of the chain path through which the chain strand passes is followed alongside by a sheet guide surface 4.7 facing towards the section, the sheet guide surface 4.7 being formed on a sheet guide device 4.6. A carrying-air cushion is preferably formed between the sheet guide surface 4.7 and the respective sheet 7 guided thereover. For this purpose, the sheet guide device 4.6 is equipped with blown-air nozzles 4.8 terminating in the sheet guide surface 4.7, only one of the nozzles 4.8 being reproduced symbolically in FIG. 1 as representative for a plurality thereof.

In order to prevent mutual adhesion of the printed sheets 7 after they have been deposited in a pile, a dryer 4.10 and a powdering device 4.11 are provided on the path of the sheets from the drive sprockets 4.2 to a sheet brake 4.9. In order to avoid excessive heating of the sheet guide surface 4.7, a coolant circuit is integrated into the sheet guide device 4.6, and is indicated symbolically in FIG. 1 by an inlet nozzle 4.12 and an outlet nozzle 4.13 on a coolant trough 4.14 assigned to the sheet guide surface 4.7. The aforementioned sheet brake 4.9 includes a multiplicity of braking modules, which, respectively, are preferably formed by a suction-belt conveyor.

From the chain conveyor 4.1, the sheets 7 are transferred into the sheet stacking or pile station 5, so that a pile 5.1 is formed therein. The stacking or pile station 5 has a leading-edge stop 5.2 in an upper sheet-receiving region thereof, and an opposing trailing-edge stop 5.3, by which the sheets are aligned. In addition, the stacking or pile station 5 has a lifting mechanism, of which there are reproduced in FIG. 1 only a platform 5.4 carrying the pile 5.1, and lifting chains 5.5 carrying the platform 5.41 the lifting chains 5.5 being represented in phantom, i.e., by dot-dash lines.

The stacking or pile station 5 is followed by a device 6 for removing proof sheets and reject sheets. In order to be able to move the reject sheets and proof sheets past the leading-edge stop 5.2 of the stacking or pile device 5, the stop 5.2 can be folded down. The device 6 for removing proof sheets and reject sheets includes a collecting container 6.3 for the proof sheets and reject sheets and will be described in detail hereinbelow.

If the proof sheets or reject sheets, the latter being also referred to as waste, are not to be deposited on the pile 5.1 but are to be removed, the opening of the grippers 4.16 carrying these sheets 7 is delayed beyond the opening or starting time for forming the pile. At the same time, the suction operation of the brake 4.9 is preferably interrupted.

When the machine is started up, provision can be made initially for all the first sheets to be removed in principle as waste until the desired quality has been attained. Thereafter, the operator can cause the succeeding sheets to be deposited on the pile 5.1. An automatic removal of proof sheets during running operation can be performed in a manner that, after a specific number of sheets have been deposited on the pile 5.1, a respective sheet is removed as a proof and for documentation purposes, for example quality assurance according to the ISO 9000 Standard.

Figure 2:
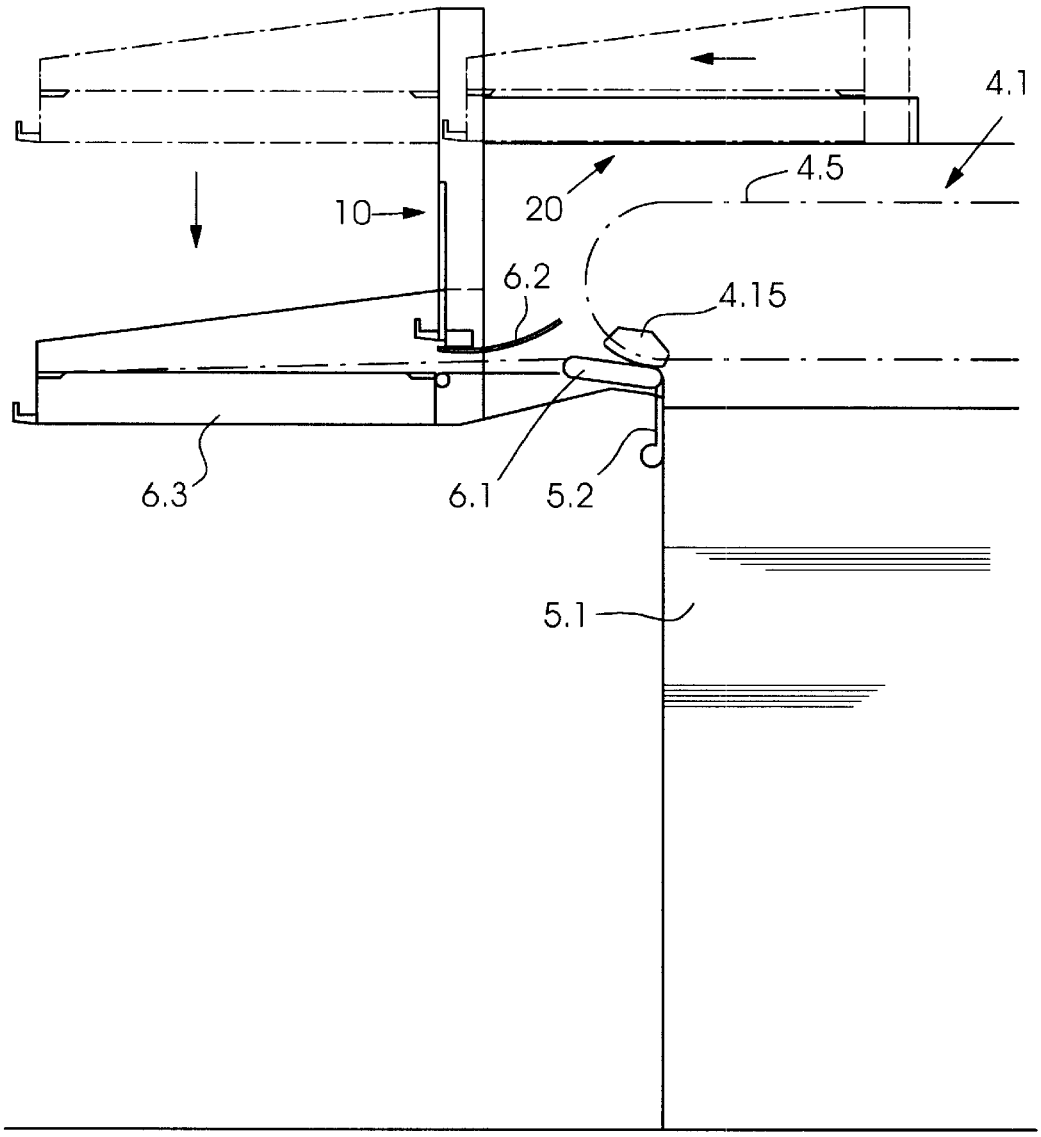
FIG. 2 is an enlarged fragmentary view of FIG. 1 showing a collecting container in displaced positions thereof.

An exemplary embodiment of the device 6 for removing proof sheets and reject sheets is illustrated in an enlarged view in FIG. 2. Underneath the outermost end of the conveyor chains 4.5, the device 6 has a further sheet brake 6.1, preferably with revolving suction belts. In addition, arranged downline of the conveyor chain 4.5 is a curved guide 6.2, by which the sheets are guided underneath a vertical guide 10 of the device 6 into the collecting container 6.3 so as to b e deposited in the latter.

In an upper region of the vertical guide 10, the device 6 has a horizontal guide 20 which extends from the vertical guide 10 over the delivery 4, in a direction towards the printing-unit section 2.

The collecting container 6.3 is connected to a slotted-guide or sliding block 6.4 and, by the latter (note FIGS. 3*a*, 3*b* and 3*c*), is guided in the vertical and the horizontal guides 10 and 20, respectively, and in the manner indicated by the arrows in FIG. 2, which correspond to the positions illustrated in phantom therein, can be moved between an upper park position and an operating position arranged downline of the guide 6.2 in order to accept the proof sheets and the reject sheets from the chain conveyor 4.1, the collecting container 6.3, when in the park position thereof, being essentially flush with the front side of the delivery 4. The movement along the guides 10 and 20 can be performed by hand, as in the instant exemplary embodiment, or else by a suitable drive.

Figure 3A:
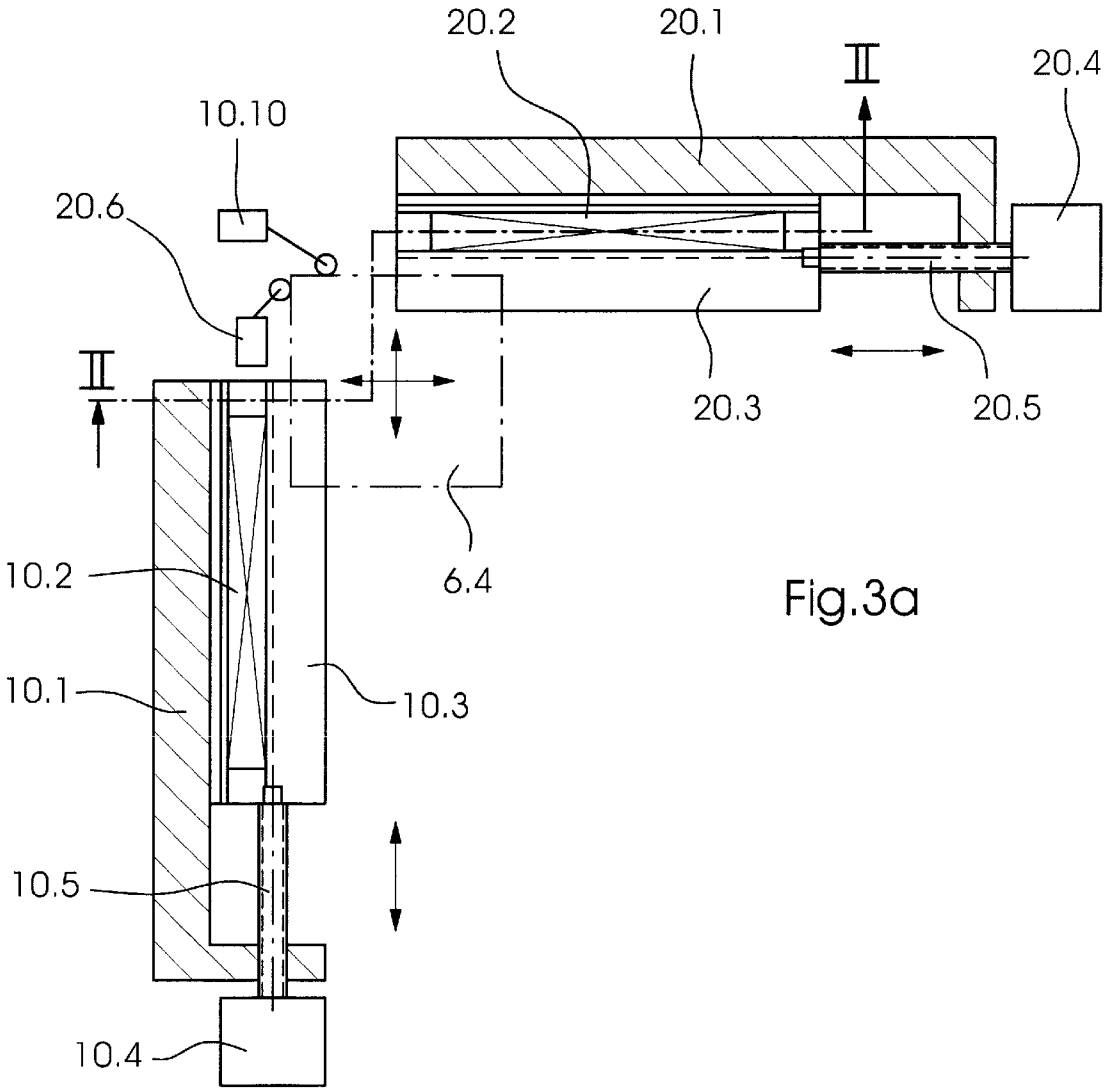
FIG. 3*a* is an enlarged fragmentary view, partly in section, of FIG. 2 showing, in greater detail and schematically, a mechanism for displacing the collecting container.
Figure 3B:
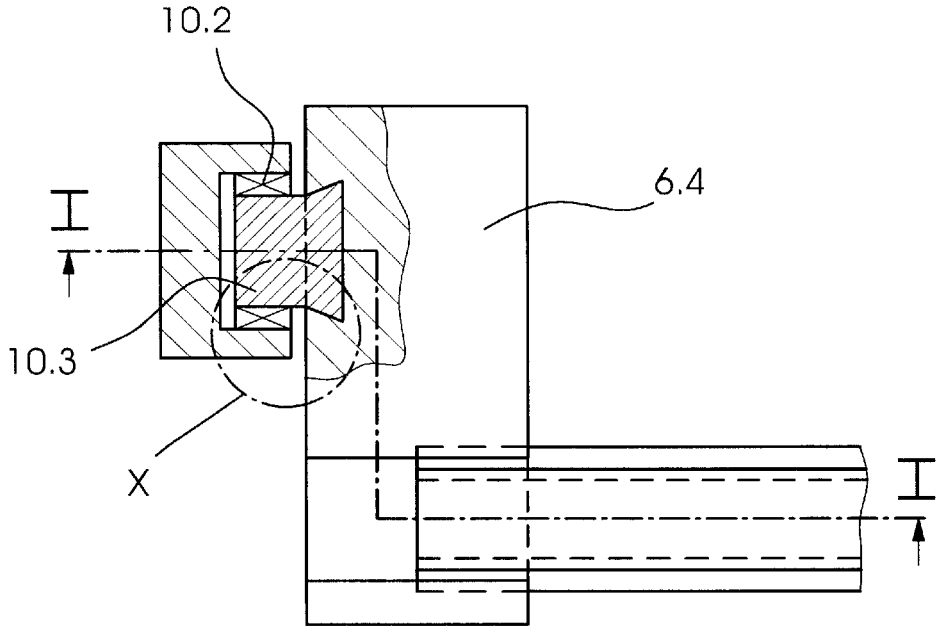
FIG. 3*b* is a sectional view of FIG. 3*a*, taken along the line II—II therein in the direction of the arrows.
Figure 3C:
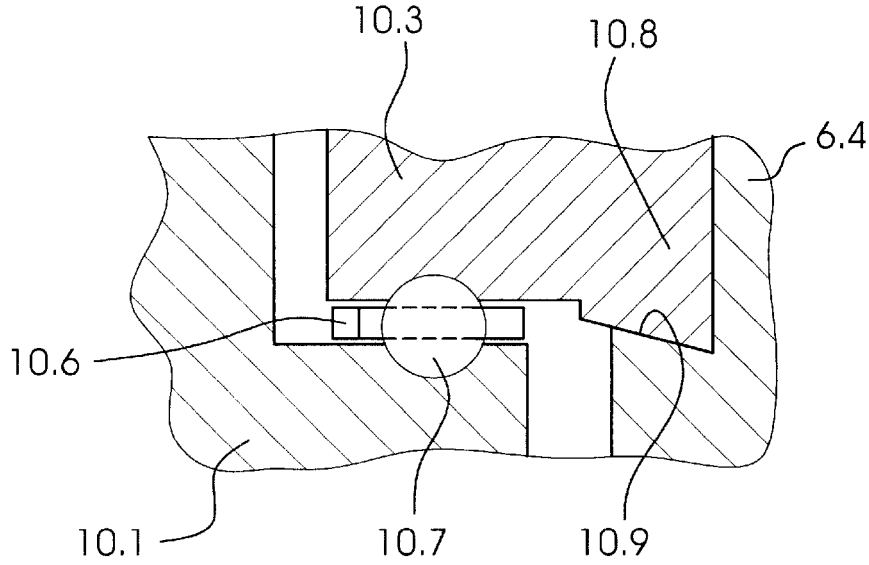
FIG. 3*c* is an enlarged view of an encircled detail X in FIG. 3*b*.

The guide system formed by the vertical guide 10 and the horizontal guide 20 for the collecting container 6.3 is illustrated in greater detail in FIGS. 3*a* to 3*c*.

The vertical guide 10 has a stationary, vertically aligned guide rail 10.1, wherein a vertical slide 10.3 is guided by a bearing 10.2. The vertical slide 10.3 can be moved along the guide rail 10.1 over a given limited region by a motor 10.4, via a threaded spindle 10.5.

The bearing, as illustrated in FIG. 3*c*, is formed as a linear ball bearing having a ball cage 10.6 and balls 10.7 which are guided in the latter and which engage in partial cylindrical recesses of the guide rail 10.1 and the vertical slide 10.3.

On a side thereof facing away from the guide rail 10.1, the vertical slide 10.3 is formed as a dovetail tongue 10.8 and engages therewith in a dovetail groove 10.9 appropriately formed in the slotted-guide or sliding block 6.4.

Arranged above the vertical guide 10 is a limit switch 10.10 actuatable by a vertical movement of the slotted-guide or sliding block 6.4.

The horizontal guide 20 is basically formed like the vertical guide 10. It has a stationary horizontal guide rail 20.1 and a horizontal slide 20.3 guided and movable horizontally in the horizontal guide rail 20.1 by a bearing 20.2, the slide 20.3 being displaceable by a motor 20.4, via a spindle 20.5. On a side thereof facing away from the guide rail 20.1, the horizontal slide 20.3 likewise has a dovetail-tongue formation (not illustrated in the drawings) corresponding to the dovetail tongue 10.8 of the vertical slide 10.3, and the slotted-guide or sliding block 6.4 further has a dovetail groove (likewise not illustrated), which is aligned horizontally with and corresponds to the dovetail groove 10.9.

Also provided is a limit switch 20.6, which the slotted-guide 14 or sliding block 6.4 strikes when, during the horizontal displacement thereof along the horizontal slide 20.3, it comes with the dovetail groove thereof into the region of the dovetail tongue 10.8 of the vertical slide 10.3.

FIGS. 4*a* to 4*e* reproduce in diagrammatic form the sequence of movements of the slotted-guide or sliding block 6.4 carrying the collecting container 6.3.

Figure 4A:
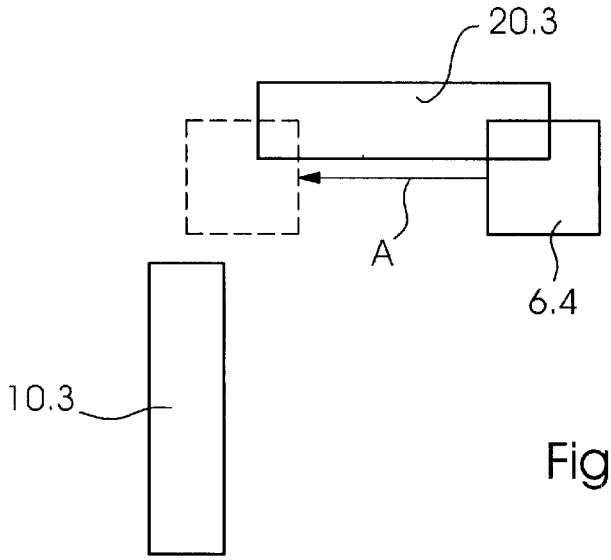
FIGS. 4*a* to 4*e* are diagrammatic and schematic views of the collecting container during a sequence of displacements thereof by the mechanism according to FIG. 3*a*.

The slotted-guide or sliding block 6.4 and, therewith, the collecting container 6.3, which is not illustrated in FIGS. 4*a* to 4*e*, are initially located in a park position illustrated at the top righthand side in FIG. 4*a*. The slotted-guide or sliding block 6.4 has the horizontally aligned dovetail groove thereof engaged with the dovetail tongue on the horizontal slide 20.3. Initially, the slotted-guide or sliding block 6.4 is moved along the horizontal side 20.3, which is held stationary, from the park position of the slotted-guide or sliding block 6.4, to the lefthand side into a transfer position illustrated by broken lines. In this position, the vertical slide 10.3 is moved, by the motor 10.4 and the spindle 10.5 (note FIG. 3*a*) actuated by the latter, into a lower release position, so that during the horizontal displacement thereof, the slotted-guide or slide block 6.4 does not strike the vertical slide 10.3 but rather can move freely into the transfer position, wherein the vertical dovetail groove 10.9 thereof is aligned with the dovetail tongue 10.8 of the vertical slide 10.3.

Figure 4B:
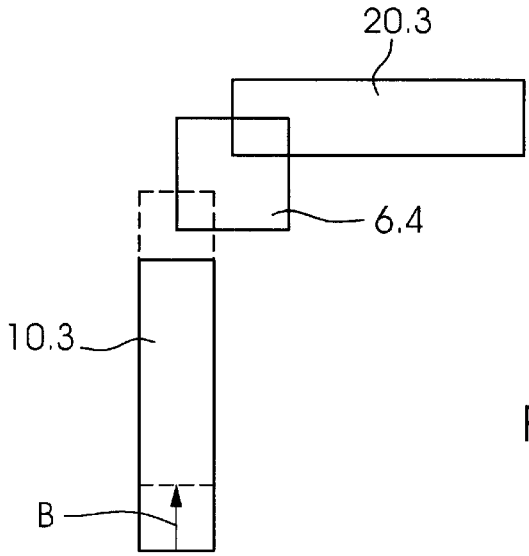
Figure 4C:
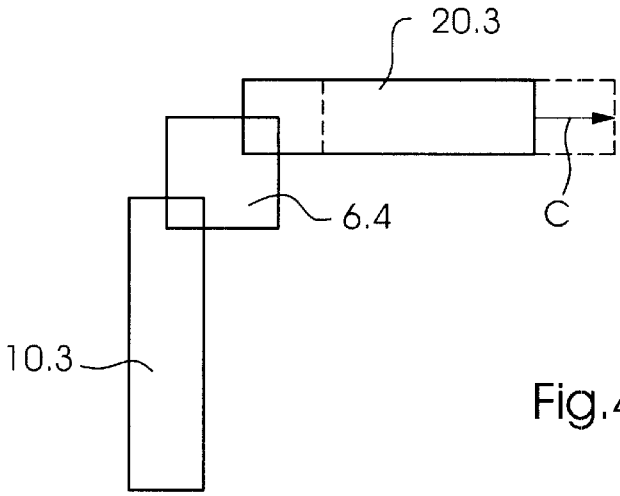
Figure 4D:
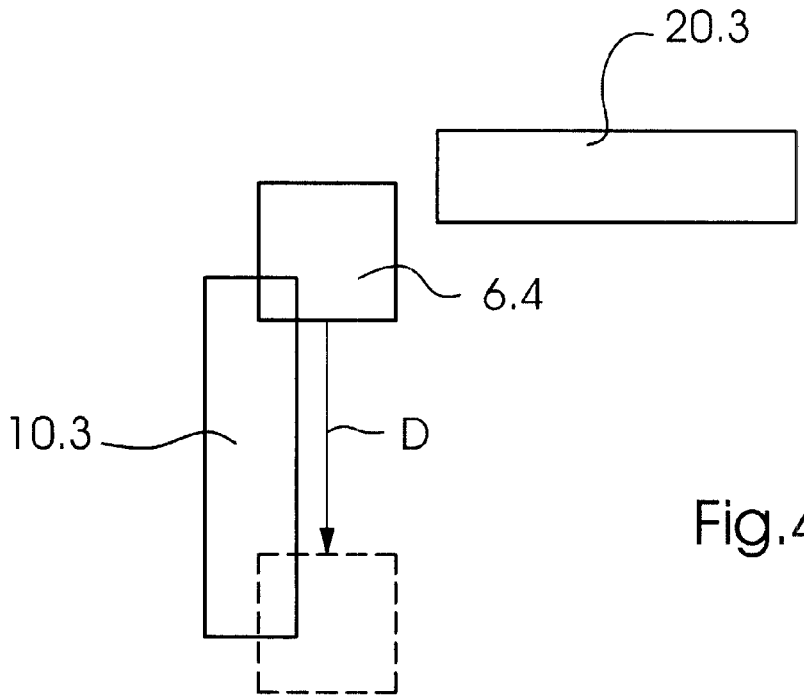

When the slotted-guide or sliding block 6.4 reaches the transfer position (note FIG. 4*b*), it strikes the switch 20.6 and operates the latter, whereupon the latter then switches the motor 10.4 on, which then moves the vertical slide 10.3 upwardly, guided by the bearing 10.2, along the guide rail 10.1, the movement corresponding to the arrow B in FIG. 4*b*, the dovetail tongue 10.8 of the vertical slide 10.3, and the dovetail groove 10.9 of the slotted-guide or sliding block 6.4 coming into engagement. When the vertical slide 10.3 has reached the end of the guide rail 10.1, and therefore the engagement with the slotted-guide or sliding block 6.4 has taken place, firstly the motor 10.4 is switched off and secondly the motor 20.4 associated with the horizontal slide 20.3 is set into operation. This can be effected by a non-illustrated switch which is provided at the end of the guide rail 10.1. The motor 20.4 thereafter moves the horizontal slide 20.3 through the intermediary of the spindle 20.5, the movement corresponding to the arrow C in FIG. 4*c*, out of engagement with the slotted-guide or sliding block 6.4, so that the horizontal slide 20.3 releases the slotted-guide or sliding block 6.4, and the latter can thereafter be moved along the vertical slide 10.3, the movement corresponding to the arrow D in FIG. 4*d*, into an appropriate position corresponding to the operating position of the collecting container 6.3 connected to the slotted-guide or sliding block 6.4. This position is illustrated in FIG. 4*e*.

Figure 4E:
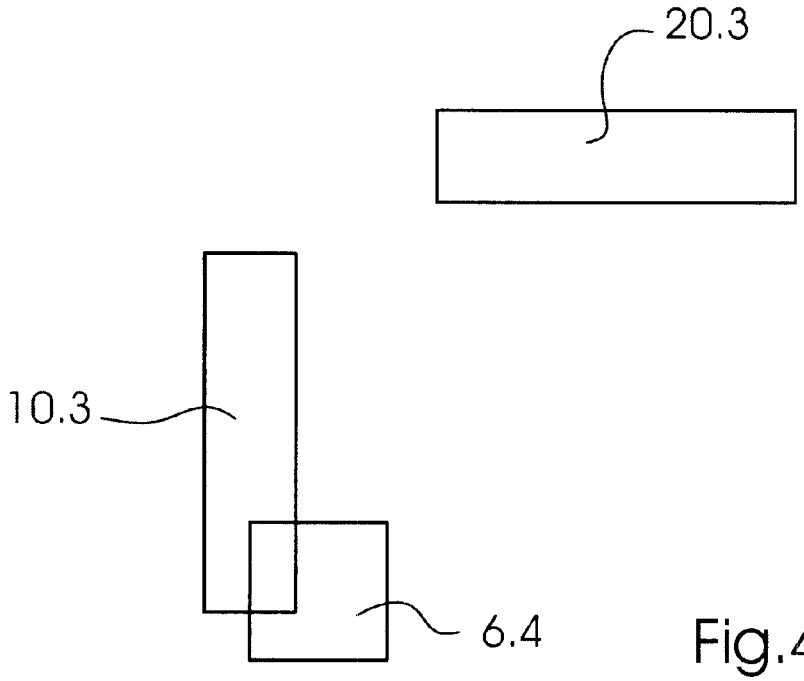

From the position of FIG. 4*e*, the slotted-guide or sliding block 6.4 can be moved again into the park position illustrated in FIG. 4*a*, the movement sequences taking place in the opposite order to those described and in the opposite directions. In particular, the engaging movement of the horizontal slide 20.3 in the slotted-guide or sliding block 6.4 after the latter has reached the transfer position is performed by the slotted-guide or sliding block 6.4 actuating the limit switch 10.10 in this transfer position, the switch 10.10 then switching the motor 20.4 on, so that the latter, via the spindle 20.5, can move the horizontal slide 20.3 into the engaged position in the slotted-guide or sliding block 6.4. The vertical slide 10.3 is lowered in a manner corresponding to that described hereinabove for returning the horizontal slide 20.3, the lowering of the vertical slide 10.3 being initiated by a limit switch, for example actuated by the horizontal slide 20.3.

We claim:

1. A sheet-processing machine, comprising:

a device for removing proof sheets and reject sheets;

a delivery having a side;

a collecting container for accommodating removed sheets, said container being displaceable from an operating position at said side of said delivery into a park position disposed above said delivery.

2. The machine according to claim 1, wherein said collecting container, when in said park position thereof, is at least approximately flush with said delivery.

3. The machine according to claim 1, including at least one sliding block carrying said collecting container, and two mutually perpendicularly aligned guides for said sliding block.

4. The machine according to claim 3, including dovetail tongues and grooves for guiding said sliding block in said mutually perpendicularly aligned guides.

5. The machine according to claim 3, wherein each of said guides has a stationary guide rail and a slide displaceable over a limited path on said guide rail.

6. The machine according to claim 5, wherein said slides, respectively, on a side thereof facing away from the respective guide rail are formed with respective dovetail tongues respectively engaging in a dovetail groove formed in said sliding block.

7. The machine according to claim 5, including bearings by which said slides are guidable in the respective guide rails thereof.

8. The machine according to claim 7, wherein said bearings are formed as linear ball bearings, respectively, having a ball cage and balls engaging in partial cylindrical grooves, respectively, formed in said guide rails and said slides.

9. The machine according to claim 8, including a threaded spindle for displacing said slides, respectively.

10. The machine according to claim 5, including a respective motor for displacing said slides along said guide rails, respectively.

11. The machine according to claim 5, including limit switches arranged in a transfer region for transferring said sliding block from one of said guides to the other, and motors switchable by said limit switches for adjusting said slides.

12. The machine according to claim 5, wherein said guides are a vertical guide and a horizontal guide, respectively and said slides are a vertical slide and a horizontal slide, respectively.

13. The machine according to claim 3, wherein said two guides are a vertical guide and a horizontal guide.

14. The machine according to claim 1, wherein, when said collecting container is in the operating position thereof for accepting the sheets, a guide is assigned to said collecting container for deflecting the sheets into said collecting container after they have been removed from said delivery.

15. The machine according to claim 1, including suction belts for conveying the sheets, said suction belts being arranged upline of said collecting chamber, when said collecting chamber is in the operating position thereof for accepting the sheets.

16. The machine according to claim 1, wherein the sheets are removable from a front or end side of said delivery.

17. A printing machine, comprising:

a device for removing proof sheets and reject sheets;

a delivery having a side;

a collecting container for accommodating removed sheets, said container being displaceable from an operating position at said side of said delivery into a park position disposed above said delivery.

* * * * *